United States Patent [19]

Bogner

[11] Patent Number: 5,020,823

[45] Date of Patent: Jun. 4, 1991

[54] BINDING COUPLED SKI BOOT SHAFT DELATCHING DEVICE

[75] Inventor: Martin Bogner, Ostfildern, Fed. Rep. of Germany

[73] Assignee: GEZE Sport International GmbH, Leonberg, Fed. Rep. of Germany

[21] Appl. No.: 383,384

[22] Filed: Jul. 20, 1989

[30] Foreign Application Priority Data

Jul. 22, 1988 [DE] Fed. Rep. of Germany ..... 3825004

[51] Int. Cl.[5] ..... A63C 9/10

[52] U.S. Cl. ..... 280/634; 36/120; 280/11.36; 280/611; 280/617; 280/625; 280/628

[58] Field of Search ..... 36/117, 120; 280/11.36, 280/628, 611, 613, 617, 625, 634, 809

[56] References Cited

U.S. PATENT DOCUMENTS

| | | | |
|---|---|---|---|
| 3,893,683 | 7/1975 | Gertsch et al. | 280/611 |
| 3,931,980 | 1/1976 | Marker | 280/618 |
| 4,133,119 | 1/1979 | Kubelka | 280/613 |
| 4,139,211 | 2/1979 | Salomon | 280/613 |
| 4,529,218 | 7/1985 | Bogner et al. . | |
| 4,603,880 | 8/1986 | Salomon | 280/634 |
| 4,640,026 | 2/1987 | Kirsch | 36/120 |

FOREIGN PATENT DOCUMENTS

| | | |
|---|---|---|
| 2808805 | 6/1979 | Fed. Rep. of Germany . |
| 3122653 | 7/1983 | Fed. Rep. of Germany . |
| 8716068 | 4/1988 | Fed. Rep. of Germany . |

*Primary Examiner*—Andres Kashnikow
*Assistant Examiner*—Eric Culbreth
*Attorney, Agent, or Firm*—Townsend and Townsend

[57] ABSTRACT

A binding coupled ski boot shaft delatching device is described in which the pivotable shaft 12 of the boot can be latched with the lower part 14 of the boot via a latching lever 20. The latching lever 20 is pivotable inwardly into a latching position by a sole clamp 64 against a spring force 34. In this way a falsification of the preset release characteristic of the sole clamp through possible interference of the shaft delatching device with the binding is precluded.

19 Claims, 4 Drawing Sheets

BINDING COUPLED SKI BOOT SHAFT DELATCHING DEVICE

DESCRIPTION

Figure 1:
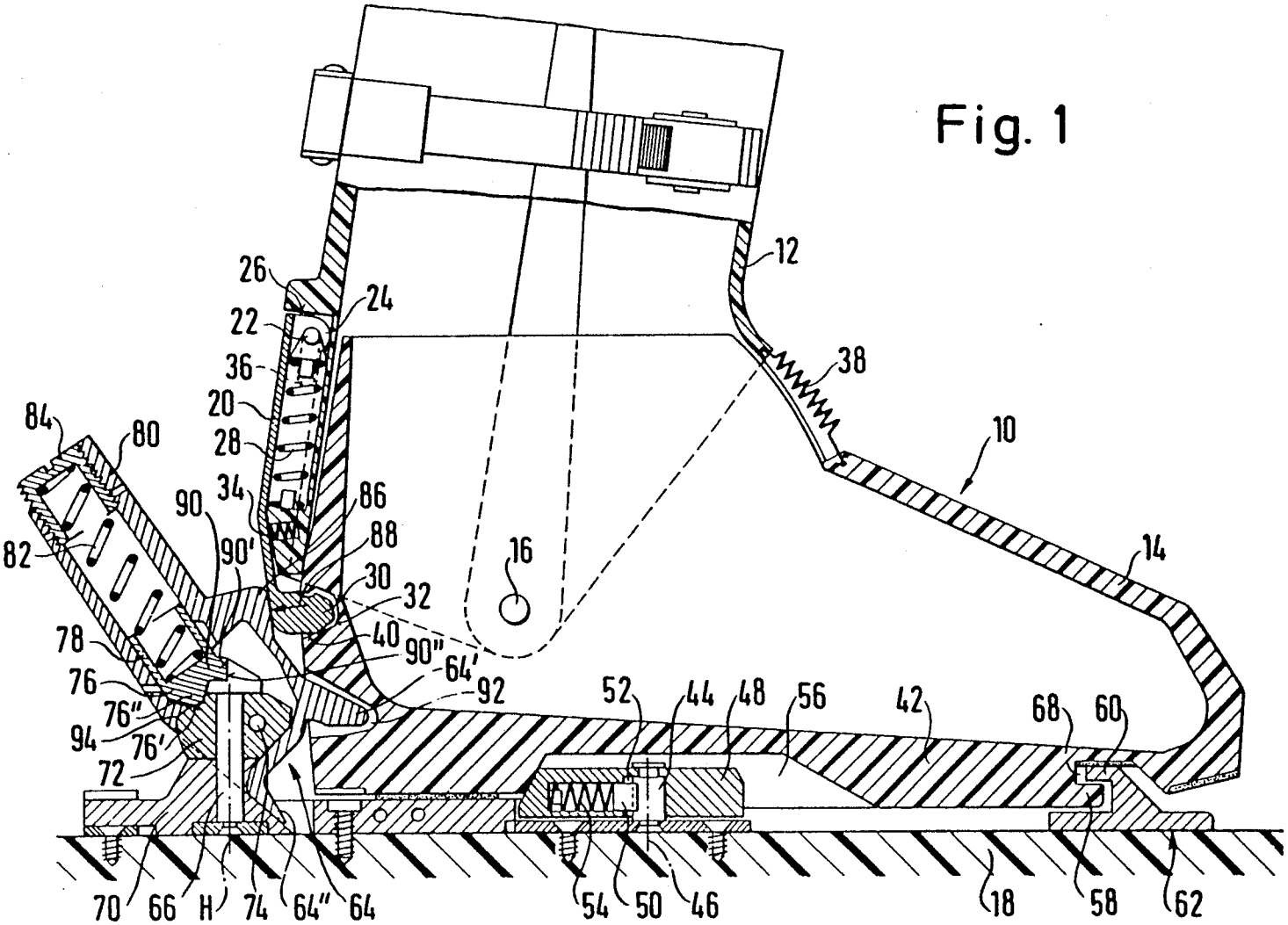

The invention relates to a binding coupled ski boot shaft delatching device comprising an intermediate part which acts on the pivotable shaft of the boot and cooperates for the latching of the shaft of the boot with a sole clamp, in particular a heel-side sole clamp, wherein the shaft of the ski boot is latched via the intermediate part when the sole clamp is closed and is freely pivotable when the sole clamp is opened. The invention relates furthermore to a safety ski binding which is preferably used in conjunction with the binding coupled ski boot shaft delatching device.

Such binding coupled ski boot shaft delatching devices are used to release the shaft of a ski boot so that it can pivot forwardly about a transverse axis in order to make walking easier. On the other hand this pivotability is supressed for skiing in that the pivotable shaft of the boot is latched via the intermediate part.

A binding coupled ski boot shaft delatching device of the initially named kind is described in DE-OS 28 08 805 in which the intermediate part acts, on one hand, on the pivotable shaft of the boot and engages, on the other hand, beneath the hold-down clamp of the heel binding.

In an apparatus for clamping a ski boot closed in accordance with DE-Gbm 87 16 068 the clamping of the ski boot closed takes place between a rear entry flap and a front shell part of the ski boot via a closing piston associated with a cable run, with the closing piston in turn being directly acted on by the sole hold-down clamp of the heel binding for the simultaneous fixation of the boot to the ski.

An unfavourable feature of the customary ski boot shaft delatching devices is the fact that the intermediate part which brings about the latching of the pivotable shaft of the ski boot interferes with the ski binding itself.

One object of the present invention is now to provide a binding coupled ski boot shaft delatching device of the initially named kind with which, despite the automatic latching and delatching of the pivotable shaft of the boot via closing and release of the sole clamp, a predetermined release characteristic of the sole clamp is achieved and effects on the sole clamp which falsify this release characteristic are practically precluded.

In order to satisfy this object the invention provides, in an arrangement of the kind initially named, that a latching lever is provided which forms the intermediate part and which is pivotable by the sole clamp against a spring force into a latched position in which it acts both on the shaft of the ski boot and also on the lower part of the boot.

The concept underlying the invention is thus to be seen in the fact that a latching lever is merely transferred by means of the sole clamp into the desired latching position and is held in this position. In this latching position the latching lever acts at one end on the shaft of the ski boot for the latching of the pivotable shaft and to the other end on the lower part of the ski boot. After each release of the sole clamp the spring force which is provided ensures that the latching lever automatically enters into the delatched position for the release of the pivotable shaft of the boot.

By providing the sole clamp with a special projection by which it exerts a force on the latching lever, in particular a projection separate from the sole hold-down clamp, one not only always ensures a reliable transfer of the latching lever into the latched position but also a clear separation is possible between the sole hold-down function and the boot shaft delatching operation.

The latching lever is expediently pivotally hinged at one end to the shaft of the boot and is bent around in hook-like manner at the free end for engagement with the lower part of the boot in the latched position. The hook-like bent around end of the latching lever hereby preferably engages into a recess provided at the rear side of the ski boot. For this purpose the sole clamp, as it snaps to, acts on the latching lever in order to press the latter into the recess, whereby the two parts of the boot are connected with one another.

In order to permit restricted pivoting of the shaft of the boot against a spring force while generating a resetting moment, even when the shaft of the boot is latched, the latter is expediently resiliently couplable with the lower part of the boot via the latching lever. Although effects of the ski boot shaft delatching device on a predetermined release characteristic of the binding should fundamentally be precluded, it can be of advantage, in particular with sole clamps which are releasable both vertically and also sideways, when for example the sole clamp is acted on in the vertical release direction via the latching lever during a rearward fall. Even without bringing about a vertical release this can for example lead to the sideways release being made easier or to friction compensation in combination with such sideways release.

Thus provision is made in accordance with a preferred variant that a cam track is arranged between the hook-like bent around end of the latching lever and the recess of the ski boot which accommodates this end so that when the shaft of the ski boot is pivoted into a rear position, and the end of the latching lever is braced in the recess, the shaft of the boot urges the sole clamp in the vertical release direction via the latching lever.

The binding coupled ski boot shaft delatching device is particularly advantageously usable in conjunction with a safety ski binding of the kind which comprises a bearing part on which a sole clamp, in particular a heel clamp, is pivotally arranged for pivotal movement about a transverse axis between a closed position and an open position, with the sole clamp being fixedly connected with a spring cage which extends away from the bearing part, and with a spring being accommodated in the spring cage and being braced at one end against the spring cage and acting at the other end in the direction towards the bearing part, or away from it, on a latching piston which is displaceably mounted at the spring cage, with the line of action of the spring extending past and being spaced from the transverse axis in the sense of generating a closing moment, and wherein a vertical release track is arranged between the latching piston and the bearing part and brings about deflection movement of the latching piston while increasing the spring tension during pivoting of the sole clamp about the transverse axis out of the closed position in the opening direction.

The substantial advantage of a known safety ski binding of this kind (German patent 31 22 653) lies in the fact that the size of the resetting force in the range of vertical elasticity approximates as far as possible, to the size of the release force without it being necessary to provide excessively strong release springs for this purpose. To this end the transverse axis is arranged relative to the central longitudinal axis extending in the direction of displacement of the latching piston with a radial spacing above or on the side facing the ski boot, while the support point between the latching piston and the counter latching element, i.e. the location at which the latching element contacts the counterlatching element, lies in the clamped position on the other side of the central longitudinal axis. As a result of this construction relatively large components of the cam track latching resistance which is to be overcome act during pivotal movement of the sole clamp out of its closed position directly in the direction of movement of the latching piston without exerting lateral forces on the latter which attempt to push the latching piston on to its guides in the spring cage. In this way one advantageously achieves a situation in which the release forces of the binding are determined essentially by the characteristics of the latch springing and also by the formation of the latching piston, and also of the counterlatching element, whereas the friction of the latching piston in the spring cage plays a comparatively small role. At the same time one thereby ensures a behaviour of the safety ski binding which can be reproduced well. In the sense of the present invention a spring cage will be understood to cover any component on which the release spring and the latching piston can be respectively braced and displaceably mounted in the desired manner.

A further advantage of the present invention now lies in further developing a safety ski binding of this kind, which can be advantageously combined with the ski boot shaft delatching device, so that the advantages of the safety ski binding known from DE-PS 31 22 653 can be maintained in a constructionally simple manner and with multiple exploitation of components, so that at the same time a problemfree lateral release can also be ensured using substantially the same means.

In order to satisfy this further object the present invention provides that the bearing par is pivotally journalled about an at least substantially vertical axis H which is fixedly mounted to the ski and thus the sole clamp is also laterally pivotable; and that a lateral release cam track is arranged between the latching piston and a counterpiece which is fixedly mounted relative to the ski, with the lateral release cam track in turn bringing about a displacement of the latching piston while increasing the spring tension during lateral pivoting of the sole clamp out of the closed position into a lateral opening direction.

With a ski safety binding of this kind, which combines a vertical release with a sideways release, the action of the latching lever of the ski boot shaft delatching device on the sole clamp in the vertical release direction during a rearward fall or during rearward pivoting of the shaft signifies that even if vertical release does not occur the sideways release is made easier and frictional forces which may possibly occur during sideways release are compensated for.

The sideways release cam track can expediently comprise a flat transverse surface of the spring-loaded latching piston and a flat transverse countersurface of the counterelement fixed relative to the ski. If the sole clamp is pivoted together with the bearing part about the at least substantially vertical axle, which is fixed relative to the ski, then the latching piston will be pressed backwards against the spring force as a result of the flat construction of the cooperating pair of surfaces, and thus a lateral resetting force will be generated.

In order to specify a defined pivot axis for the ski boot a pivotal member is advantageously provided which is pivotally journalled about a vertical axle fixed relative to the ski and which can be brought into fixed rotational engagement with the ski boot, for example by cooperating projections and recesses provided on the two components. In this way the ski boot is forced to pivot about a clear axis which is located beneath the tibia, which is important for a clean release.

A front sole hold-down clamp which is fixedly mounted on the ski and which has a rearwardly projecting projection spaced from the ski which engages in a laterally through-going slot in the lower part of the ski boot is preferably additionally provided.

The laterally through-going slot ensures that on a rotation of the ski boot about the defined axis the boot can release sideways from the sole hold-down clamp at the front. The front sole hold-down clamp satisfies a pure shoe sole hold-down function such as normally also is provided by a customary front toe unit. An actual front toe unit is not required. Both the vertical release and also the sideways release is satisfied by the heel unit.

In a safety ski binding having a heel-side sole clamp which only releases vertically and which can be advantageously combined with the ski boot shaft delatching device, there is preferably provided, in accordance with the invention, a pivotal member which is pivotally mounted about a vertical axle fixed relative to the ski and which is pivotally journalled about a vertical axle fixed relative to the ski, with the pivotal member being engageable with the ski boot in a rotationally fixed manner to specify a defined pivotal axis of the ski boot, and a slider, which engages at the front outer end in hook-like manner around an abutment fixed relative to the ski, with the slider being longitudinally displaceably guided in the pivotal member and being spring-loaded in a sense of hooking onto the abutment.

In this arrangement the vertical axle is preferably defined by a vertical spigot fixed relative to the ski which has a flattened portion at its front side against which the spring-loaded slider is held, so that the slider is displaced forwardly against the spring force on pivoting of the pivotal member and comes free sideways from the transversely extending abutment, which is in particular a u-shaped abutment, in order to permit lateral release.

Figure 2:
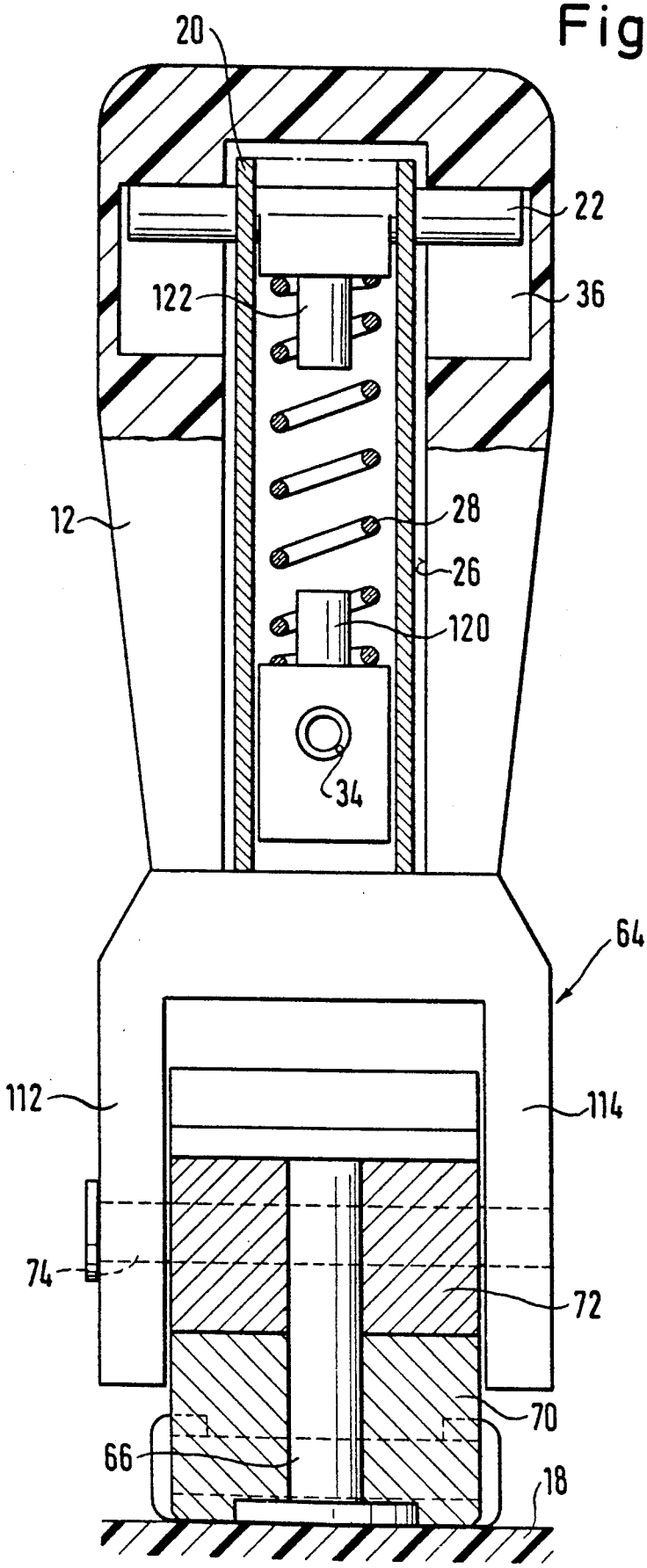
Figure 3:
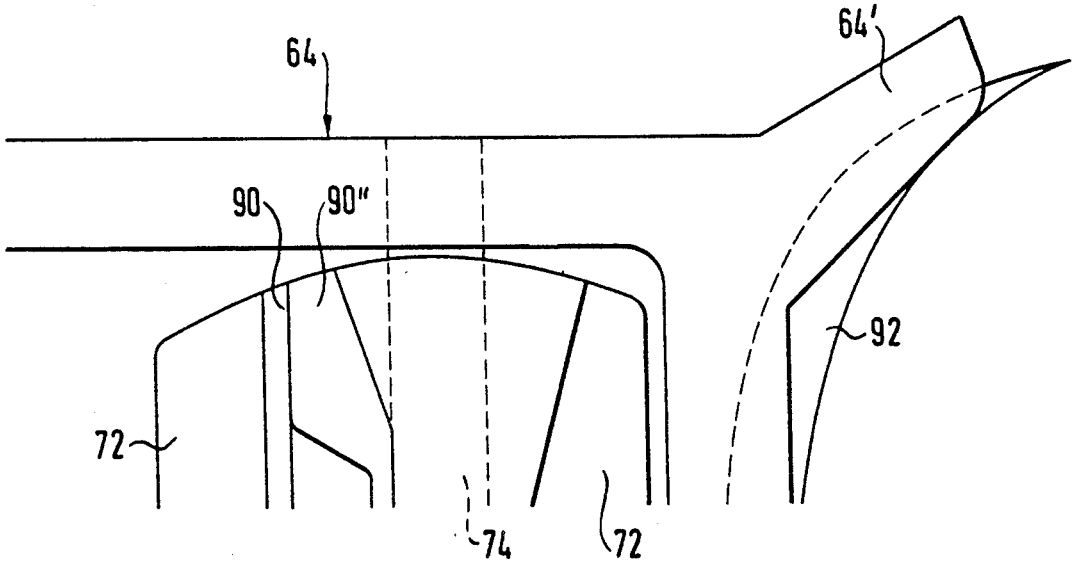
Figure 4:
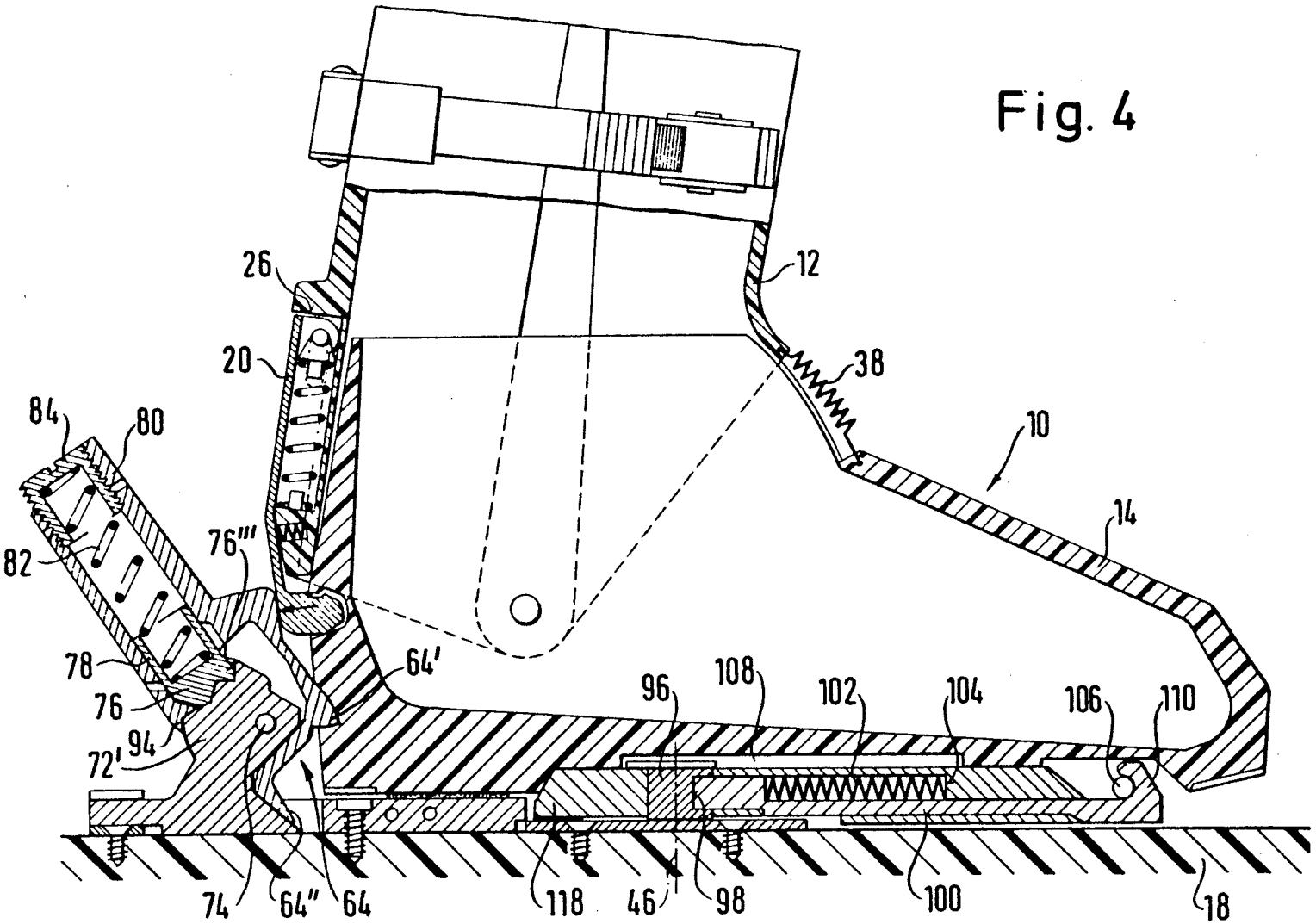

The invention will now be explained in more detail with reference to embodiments and to the drawings in which are shown:

FIG. 1 a partially sectioned sideview of a ski safety binding and also of a binding coupled ski boot shaft delatching device, FIG. 2 a partially sectioned rearview of the subject of FIG. 1, FIG. 3 a partially sectioned plan view of the sole clamp shown in FIG. 1 with the associated bearing unit, and FIG. 4 a partially sectioned sideview of another embodiment of the safety ski binding and also of a binding coupled ski boot shaft delatching device corresponding to FIG. 1.

As seen in FIG. 1 a ski boot 10 is secured to a ski 18 by means of a ski safety binding with the ski boot having a lower part 14 fixed to the ski and also a boot shaft 12 which is pivotable about a transverse axle 16. The two parts of the boot are connected together at the front via a spring element 38.

The ski boot 10 has a binding coupled ski boot shaft delatching device at its rear side. This ski boot shaft delatching device includes a latching lever 20 which engages at the one end on the shaft of the boot and at the other end on the lower part of the boot, in order to latch the pivotable shaft 12 of the boot to the lower part 14 of the boot.

The latching lever 20 is pivoted into the latching position against the force of a spring 34 by a heel-side sole clamp 64.

In order to act on the latching lever 20 the sole clamp 64 has a special nose-like projection 86. This projection 86 is arranged separately above the sole hold-down clamp 64' of the sole clamp 64.

The latching lever 20 is pivotally hinged at the upper end to the shaft 12 of the boot, whereas it is bent around in hook-like manner towards the ski boot 10 at the other free end for engagement with the lower part 14 of the boot. In the latched position the hook-like bent around end of the latching lever 20 engages into a recess 32 provided at the rear side of the lower part 14 of the boot.

The shaft 12 of the boot is elastically couplable to the lower part 14 of the boot via the latching lever 20. In this arrangement a restricted pivotal movement of the shaft of the boot is permitted against a spring force, even when the shaft 12 of the boot is latched, with the pivoting of the shaft simultaneously generating a resetting moment.

The lever pivot axle is formed by a transverse axle 22 which is fixedly connected with the latching lever 20.

As FIG. 2 in particular shows, this transverse axle 22 of the latching lever 20 is guided sideways in the region of its two ends in an elongate slot 36 in or at the shaft 12 of the boot, with the elongate slot extending substantially parallel to the rear wall of the boot.

The upper portion of the latching lever 20 is received in a recess 26 of the shaft 12 of the boot. Here the latching lever is urged by a spring 28 into an upper position in which the transverse axle 22 abuts against the upper boundary of the elongate slot 36. The spring 28 is supported at the one end at the end of the latching lever carrying the transverse axle 22 and at the other end on a transverse wall of the pivotable shaft 12 of the boot which bounds the recess 26 at the bottom. A projection 120 is provided on this transverse wall and the relevant end of the spring 28 is pushed over this projection (see FIG. 2). A corresponding projection 122 is provided for the same purpose for the other end of the spring 28 in the region of the transverse axle 22 on or at the latching lever 20.

The spring 28, which is braced at the lower end against a transverse wall of the shaft 12 of the boot which bounds the recess 26 and at the upper end against the latching lever 20, enables the aforementioned restricted pivoting of the shaft 12 of the ski boot to take place in a forward direction despite the latching device. Pivoting of this kind takes place against the force of the spring 28 and simultaneously generates a resetting moment.

The spring 34 which biases the latching lever 20 into a delatched position is received in a recess provided in the lower portion of the shaft 12 of the boot which bounds the recess 26. This spring 34 is braced at the one end at the base of this recess and at the other end against the latching lever 20.

As can for example be seen from FIG. 1 the lower portion of the latching lever 20 is slightly angled towards the ski boot 10 relative to the upper portion and extends parallel to the outer wall of the lower portion of the shaft 12 of the boot, which is likewise angled.

The fact that the latching lever 20 is mainly brought into the latched position, and latches there with the lower part of the boot 14, on closing of the sole clamp 64, due to the special projection 86 of the sole clamp acting on the lower portion of the latching lever, means that this binding coupled ski boot shaft delatching device does not interfere in practice with the binding, i.e. no falsification takes place of the predetermined or preset release characteristic of the sole clamp 64. On the contrary a normal heel binding is for example already sufficient for the purposes of the present invention; in particular a heel binding which has a correspondingly formed abutment 86 which, on snapping to of the binding, acts from the rear on the latching lever and presses the latter into the recess 32 of the lower part 14 of the boot, whereby the two boot parts are connected to one another. At the same time, on opening the binding, the spring 34 causes the latching lever 20 to automatically be pressed out of the latching recess of the lower part of boot so that one can at once walk normally and comfortably again without having to manipulate the lever by hand.

Between the hook-like bent around end of the latching lever 20, which forms a type of latching spigot 30, and the recess 32 of the ski boot 10 which accommodates this end, there is provided a cam 40 with an oblique cam track formed by the lower wall of the recess 32 on which the latching spigot 30 is supported. The cam track 40 is laid out or arranged in such a way that when the shaft 12 of the boot is pivoted into the rearward position and when the latching spigot 30 is braced in the recess on its cam track the shaft 12 of the boot exerts a force on the sole clamp 64, via the latching lever 20 and the projection 86, in the region of the arrow 88 in the vertical release direction. During this action the upper left-hand outer edge of the latching lever 20 is braced against the upper transverse wall of the shaft 12 of the boot which bounds the recess 26. At the opposite side of the transverse axle the latching lever 20 is braced via a round projection 24 against the inner wall of the shaft 12 of the boot which bounds the recess 26. This round projection 24 facilitates a pivoting of the latching lever 22 while simultaneously contacting the named inner boundary wall.

In the first embodiment in accordance with FIGS. 1 to 3 a safety ski binding is provided which cooperates with the binding coupled ski boot shaft delatching device and is laid out both for vertical release and also for sideways release.

As the FIGS. 1 to 3 show the ski safety binding includes a bearing part 72 on which a sole clamp 64, in the present case a heel clamp, is arranged for pivotal movement about a transverse axis 74 between a closed position and an opened position. This sole clamp 64 is fixedly connected with a spring cage 80 which extends away from the bearing part 72 and which, in the present case, is formed in one piece with the latter.

A spring 82 is arranged in the spring cage 80 and is braced at the one end against a pre-stressing insert 84, which is for example screwed into the spring cage, and at the other end against a latching piston 78, which is displaceably journalled in the spring cage 80. This latching piston 78 is displaceable in the longitudinal direction of the spring cage 80 against the force of the spring 82 away from the bearing part 72. The line of action of the force of the spring 82 extends past the transverse axis 74 at a distance therefrom in a sense generating a closing moment. A vertical release cam track 76 is arranged between the latching piston 78 and the bearing part 72 and causes the latching piston 78 to be displaced backwardly while increasing the tension of the spring 82 during pivoting of the sole clamp 64 about the transverse axis 74 out of the closed position in the opening direction.

The vertical cam track 76 comprises a cam track 76' formed on the bearing part 72 and a latching projection 76'' formed on the latching piston 78. The sole clamp 64 furthermore includes a sole hold-down clamp part 64' which acts on the sole of the lower part of the boot 14 from above and, at the bottom, a pedal part 64'' provided for the closing of the binding.

If a vertical force which reaches the release value acts on the sole clamp then the sole clamp 64 pivots with the spring cage 80 in a counterclockwise sense with the latching piston 78 being urged rearwardly while compressing the spring 82 as a result of the latching projection 76'' sliding along the cam track 76'. As soon as the culmination point 94 of the cam track has been exceeded the sole clamp 64 automatically snaps into the open position.

In order to simultaneously facilitate a lateral release the bearing part 72 is pivotally journalled about a vertical axis H fixed relative to the ski. The sole clamp 64 including the spring cage 80 is accordingly also pivotable sideways together with the bearing part 72.

A lateral release cam track 90 is arranged between the latching piston 78 and a counterelement fixed relative to the ski and formed by a bearing spigot 66. This lateral release cam track 90 again brings about a rearward displacement of the latching piston 80 with increase of the tension of the spring 82 during lateral pivoting of the sole clamp 64 out of the closed position in a lateral opening direction.

The sideways release cam track 90 can in the simplest case comprise a flat transverse surface 90' on the spring-loaded latching piston 78 and a flat transverse countersurface 90'' on the bearing spigot 66 which is fixed relative to the ski. It can in particular be recognized in FIG. 3 that the flat transverse countersurface 90'' of the described embodiment is formed by two laterally outwardly disposed portions of which only one is shown in FIG. 3. In the central region the relevant wall extends back to the transverse axle 74 and the transition follows a rounded curve in section.

Furthermore, it can be seen in FIG. 3 how the transverse axle 74 passes through the bearing part 72 on the one hand and, on the other hand, is journalled in the side walls 112, 114 (see FIG. 2) of the sole clamp 64. Finally a recess 92 in the sole region of the lower part 14 of the ski boot is indicated in FIG. 3, in just the same way as in FIG. 1, into which the sole hold-down clamp part 64' of the sole clamp 64 enters. Thus the bearing spigot 66 which is fixed relative to the ski passes through the bearing part 72 and the lateral release cam track 90 is arranged at the outer end of the bearing part 72 remote from the ski 18.

The end of the bearing spigot 66 having the lateral release cam track 90 is formed as a broadened head. The bearing part 72 which is set onto the bearing spigot 66 is arranged between this broadened head and a pedestal 70 fixed relative to the ski. The sole clamp 64' is accordingly pivotable sideways about the vertical axis H defined by the bearing spigot 66 fixed relative to the ski. The pair of surfaces 90' and 90'' can be of flat construction. As a consequence of the flat construction of the pair of surfaces 90', 90'' of the sideways release cam track 90, the spring-loaded latching piston 78 is pressed backwardly with each pivotal movement so that a sideways resetting force is always generated. The ski boot 10 is released sideways beyond a predetermined angle of pivoting of the sole clamp 64. On the other hand the sideways force always collapses as soon as a vertical release starts, since the latching piston is also pushed away from the bearing part or the bearing spigot with each vertical release.

The ski safety binding in accordance with the first embodiment furthermore includes a pivotal member 48 which is pivotably journalled about a vertical axis 46 fixed relative to the ski. This vertical axis 46 which stands perpendicular to the ski 18 is defined by a vertical spigot 44 which is preferably secured to the ski 18 in the region of the ankle. In order to fix a defined rotational axis for the ski boot the pivotal member 48 mounted on the vertical spigot 44 is at least partially received in an elongate slot 56 at the underside of the lower 14 of the boot.

The vertical spigot 44 has a flattened portion at its side associated with the heel clamp 64 and a latching piston 50 loaded by a spring 54 is held against this flat portion. A resetting moment is consequently generated for each pivotal movement of the ski boot 10 and thus of the pivotal member 48. The pivotal member 48 has furthermore a free space 52 for the air displaced by the latching piston 50.

In addition, a front sole hold-down clamp 62 fixed to the ski is provided. This blocklike sole hold-down clamp 62 has a projection 60 which projects rearwardly and is spaced from the ski 18. This projection 60 engages into a laterally through-going slot 68 in the lower part 14 of the boot. Accordingly a formation 58 in the sole region of the lower part 14 of the boot engages beneath the said projection 60.

A special feature of this first embodiment of the safety ski binding is accordingly the fact that no actual front binding unit is provided but rather a longitudinal slot is formed in the centre of the boot in which a pivotal member which is pivotally journalled on the ski is received. In this way the ski boot is forced to execute a clear pivotal movement about an axle which is preferably located beneath the tibia. This is important for a clean release. At the front the formation 58 of the sole engages beneath the projection 60 of the sole hold-down clamp 62 with the laterally through-going slot 68 ensuring that on a rotation about the vertical axis 46 the boot can release sideways from the hold-down device at the front. This sole hold-down device has a pure boot sole hold-down function such as is otherwise also provided by a customary toe binding. Both the vertical release and also the sideways release take place merely via the heel binding. During a rearward fall the lower latching spigot 30 of the latching lever 20 is braced on the cam track formed by the lower boundary of the recess 32. The sole clamp 64 is thus loaded via the projection 86 in the vertical release direction in the region of the arrow 88. This loading of the sole clamp 64 results in the sideways release being made easier and in a compensation of the frictional forces which occur at the front sole hold-down device. This is a consequence of the pivoting of the sole clamp about the transverse axle 74 (see also FIG. 2), which is mounted in the side walls 112, 114 and which passes through the bearing part 72, and of the associated pushing of the spring-loaded piston 78.

In order to further reduce these frictional forces, in particular for a sideways release, the projection 58 of the sole of the boot engages, as FIG. 1 shows, with play into the intermediate space disposed beneath the projection 60 of the front sole hold-down clamp 62. On the other hand a frictional lining can be provided between the sole and the surface of the projection 60, in particular at the sole. During a rearward fall this frictional lining automatically moves out of engagement with the projection 60 or the sole respectively.

In the second embodiment of FIG. 4 the same ski boot shaft delatching device is provided with the same latching lever 20 as in the first embodiment. In contrast the heel holder 64 which cooperates with the ski boot shaft delatching device is laid out solely for a vertical release, in distinction to the first embodiment, whereas a special sideways release is provided in the front region of the sole of the boot.

In accordance with FIG. 4 the bearing part 72' on which the sole clamp 64 is pivotally arranged about the transverse axis 74 is fixedly mounted on the ski 18. Between the latching piston 78 and the bearing part 72' there is furthermore arranged a vertical release cam track 76. A sideways release cam track is not provided. Instead the latching piston 78 has a flank 76''' along which the projection of the bearing part 72' which determines the culmination point 94 can slide after exceeding the culmination point. The flank 76''' is obliquely formed so that an opening moment is exerted on the sole clamp 64 as soon as the named projection has reached the flank 76'''.

The sole clamp 64 has in turn a sole hold-down part 64' and also a pedal 64'', with the sole hold-down part 64' being shorter in comparison to the first embodiment.

Alongside the sole or heel holder 64 which is merely laid out for vertical release there is provided a pivotal member 118 which is pivotally journalled about a vertical axis 46 fixed relative to the ski. The pivotal member 118 can be brought into a rotationally fixed engagement with the ski boot 10 in order to fix a defined pivot axis for the ski boot. The pivotal member is chamfered off at the ends to facilitate insertion of the boot into the binding, in the same way as in the first embodiment.

The vertical axis 46 is defined by a vertical spigot 96 fixed relative to the ski on which the pivotal member 118 is mounted.

A slider 100 is longitudinal displaceably guided in the pivotal member 118 and emerges out of the pivotal member in the region of the tip of the boot. The slider 100 is bent upwardly and back towards the heel with a spacing from the ski 18 in order to form a hook 110 at this outer front end. With this hook-like end 110 the slider 100 engages from the front around an abutment 106 fixed relative to the ski boot, with this abutment in particular surrounding a transversely extending spigot and preferably being shaped in the form of a u-shaped hoop.

The slider 100 is loaded by a spring 102 in the sense of a hooked engagement with the u-shaped abutment 106 which is fixedly mounted to the ski. For this purpose the slider 100 comprises a rear piston-like portion which is held against a front flattened portion 98 of the vertical spigot 96. The spring 102 is braced at the one end against the inwardly disposed transverse wall of the pivotal member 118 and at the other end at the front end wall of the rear piston-like portion of the slider 100.

The pivotal member 118 enters into a recess 108 at the lower side of the ski boot 10.

Pivotal member 118 will pivot around the vertical axis 46, together with ski boot 10. As the vertical axis 46 is defined by the vertical spigot 96 fixed relative to the ski, the pivotal member 118 together with the slider 100 is pivoted relative to the spigot 96 comprising the flattened portion 98.

Therefore, the rear piston-like portion of the slider 100 contacts the flattened portion 98 of the spigot 96 in a normal position of the ski boot 10 and the slider 100, whereas this rear piston-like portion comes into contact with the region of the circumference of the spigot 96 adjacent to the flattened portion 98 when the ski boot 10, the pivotal member 118 and the slider 110 are longitudinally displaceably guided in the pivotal member 118 are pivoted about the axis 46. When the rear piston-like portion of the slider 110 comes into contact with the circumferential region of the spigot 96 adjacent to the flattened portion 98, the slider 110, which is longitudinally displaceably guided within the movable member 118, is moved outwardly against the spring force 102.

Therefore, the slider 100 is displace forwardly as a result of the spigot 96 fixed relative to the ski boot 10 and thus the pivotal member 118 together with the slider 110 are pivoted around the vertical axis 46. When the slider 100 is displaced forwardly, the hook-like end 110 of the slider 100 comes free sideways from the u-shaped abutment 106 which is fixed relative to ski boot 10 and has a transversely extending bar for the purpose of sideways release. During such a pivotal movement of the boot the hook-like end 110 of the slider 100 slides along the said transverse bar until the sideways release takes place. For this purpose a corresponding pivotal movement of the boot is permitted in the region of the heel unit. After such a release the ski boot 10 can be freely moved upwards.

I claim:

1. A binding coupled ski boot shaft delatching device comprising:

a latching lever, which extends along and essentially parallel to a rear outer surface of a ski boot, and having a first end secured to a ski boot pivotable shaft and a free end detachably connected to a ski boot lower part, which secures said pivotable shaft to said lower part when in a latched position and wherein said pivotable shaft is pivotable when said latching lever is in an open position;

a spring, coupled to said latching lever, for biasing said latching lever in the open position;

a sole clamp, having a boot engagement member which engages the lower part of said ski boot when said sole clamp is in a closed position and a latching lever engagement member which contacts an outer surface of said latching lever when said sole clamp is in the closed position and exerts a force on said latching lever opposite a force exerted by said spring; and wherein when said sole clamp is in the closed position, said ski boot is secured to said ski and said latching lever is maintained in the latched position and when said sole clamp is in an open position.

2. The binding coupled ski boot shaft delatching device of claim 1, wherein the sole clamp latching lever engagement member comprises a projection which engages the outer surface of said latching lever.

3. The binding coupled ski boot shaft delatching device of claim 1, wherein the latching lever is pivotally hinged at said first end to the shaft of the boot and is bent around in a hook-like form at the free end which engages the lower part of the ski boot when said latching lever is in the latched position.

4. The binding coupled ski boot shaft delatching device of claim 1, wherein the free end of the latching lever is bent around in a hook-like manner and engages into a recess provided at a rear side of the lower part of the ski boot.

5. The binding coupled ski boot shaft delatching device of claim 1, further comprising: a second spring contained within said latching lever; wherein the pivotable shaft can be elastically coupled with the lower part of the ski boot via the latching lever, in order to permit restricted pivoting of the pivotable shaft of the ski boot against a spring force, even when the pivotable shaft of the ski boot is latched; and wherein said second spring generates a resetting moment to return said pivotable shaft to an initial position from a pivoted position.

6. The binding coupled ski boot shaft delatching device of claim 1, further comprising: a cam track, arranged between the free end of the latching lever, which is bent around in a hook-like manner, and a recess of the ski boot which accommodates the hook-like end, in such a way that when the pivotable shaft of the ski boot is pivoted into a rear position and the free end of the latching lever is braced in the recess, motion of the latching lever along the cam track caused by motion of the pivotable shaft of the ski boot forces the latching lever against the latching lever engagement member and urges the sole clamp in the vertical release direction via the latching lever.

7. The binding coupled ski boot shaft delatching device, of claim 1, further comprising: a bearing part on which the sole clamp, pivots about a transverse axis between the closed position and the open position; a spring cage, fixedly connected with the sole clamp, which extends away from the bearing part; a second spring, located within the spring cage and being braced at one end against the spring cage and acting at an other end on a latching piston which is displaceably mounted at the spring cage; wherein a line of action of the second spring extends past and is spaced from a transverse axis to generate a closing moment; a vertical release track arranged between the latching piston and the bearing part which brings about a deflection movement of the latching piston while increasing a spring tension during pivoting of the sole clamp abut the transverse axis from the closed position to the open position;

wherein the bearing part is pivotally journalled about an at least substantially vertical axis (H) which is fixedly mounted to the ski and thus the sole clamp is also laterally pivotable; and a lateral release cam track arranged between the latching piston and a counterpiece, which is fixedly mounted relative to the ski, wherein the lateral release cam track brings about a displacement of the latching piston while increasing the spring tension during a lateral pivoting of the sole clamp from the closed position into a lateral opening direction.

8. The binding coupled ski boot shaft delatching device of claim 7, wherein at least one of the vertical release cam track and the lateral cam track are so formed that an opening moment acts on the sole clamp beyond a predetermined pivoting angle of the same, so that the sole clamp releases the ski boot.

9. The binding coupled ski boot shaft delatching device of claim 7, further comprising:

a pivotal member which is pivotally journalled about a vertical axis fixed relative to the ski, with the pivotal member being engagable with the ski boot to define a pivotal axis for the ski boot.

10. The binding coupled ski boot shaft delatching device of claim 9, wherein the vertical axis is defined by a vertical spigot which is fixed relative to the ski; and wherein the pivotal member, which is mounted onto the vertical spigot, engages into an elongate slot on a lower side of the ski boot.

11. The binding coupled ski boot shaft delatching device of claim 7, further comprising a front sole hold-down clamp, which is fixed the ski, and has a rearwardly projecting projection which is spaced from the ski and engages into a laterally through-going slot in a lowerpart of the ski boot.

12. The delatching device of claim 1, further comprising: a heel-side sole clamp which is only releasable vertically;

a pivotal member which is pivotally journalled about a vertical axis fixed relative to the ski; wherein the pivotal member is engagable with the ski boot to specify a defined pivotal axis of the ski boot; a slider, which engages at a front outer end in a hook-like manner around an abutment fixed relative to the ski, and which is longitudinally displaceably guided in the pivotal member and is spring-loaded to hook onto the abutment.

13. The delatching device of claim 12, wherein the vertical axis is defined by a vertical spigot fixed relative to the ski which has a flattened portion at its front side against which the slider is held; and wherein when the slider is displaced forwardly against a spring force on pivoting of the pivotal member, said slider comes free sideways from the abutment and permits lateral release of the ski boot.

14. The binding coupled ski boot shaft delatching device of claim 1 wherein said sole clamp engages a heel portion of said ski boot.

15. A binding coupled ski boot shaft delatching device comprising:

a latching lever, having a first end secured to a ski boot pivotable shaft and a free end detachably connected to a ski boot lower part, which secures said pivotable shaft to said lower part when in a latched position and wherein said pivotable shaft is pivotable when said latching lever is in an open position;

a spring, coupled to said latching lever, for biasing said latching lever in the open position;

a sole clamp, having a ski boot engagement member which engages the lower part of said ski boot when said sole clamp is in a closed position and a latching lever engagement member which contacts an outer surface of said latching lever when said sole clamp is in the closed position and exerts a force on said latching lever opposite a forced exerted by said spring; and wherein when said sole clamp is in the closed position, said ski boot is secured to said ski and said latching lever is maintained in the latched position and when said sole clamp is in the open position, said ski boot is released from said ski and said latching lever is in the open position;

a bearing part on which the sole clamp pivots about a transverse axis between the closed position and the open position;

a spring cage, fixedly connected with the sole clamp, which extends away from the bearing part;

a second spring, located within the spring cage and being braced at one end against the spring cage and acting at an other end on a latching piston which is displaceably mounted at the spring cage;

wherein a line of action of the second spring extends past and is spaced from a transverse axis to generate a closing moment;

a vertical release track arranged between the latching piston and the bearing part which brings about a deflection movement of the latching piston while increasing a spring tension during pivoting of the sole clamp about the transverse axis from the closed position to the open position;

wherein the bearing part is pivotally journalled about an at least substantially vertical axis (H) which is fixedly mounted to the ski and thus the sole clamp is also laterally pivotable; and a lateral release cam track arranged between the latching piston and a counterpiece, which is fixedly mounted relative to the ski, wherein the lateral release cam track brings about a displacement of the latching piston while increasing the spring tension during a lateral pivoting of the sole clamp from the closed position into a lateral opening direction; an outer end of a bearing spigot which is associated with the lateral release cam track formed as a broadened head; and the bearing part is mounted on the bearing spigot, arranged between the broadened head of a pedestal which is fixed relative to the ski.

16. A binding coupled ski boot shaft delatching device comprising:

a latching lever, having a first end secured to a ski boot pivotable shaft and a free end detachably connected to a ski boot lower part, which secures said pivotable shaft to said lower part when in a latched position and wherein said pivotable shaft is pivotable when said latching lever is in an open position;

a spring, coupled to said latching lever, for biasing said latching lever in the open position;

a sole clamp, having a boot engagement member which engages the lower part of said ski boot when said sole clamp is in a closed position and a latching lever engagement member which contacts an outer surface of said latching lever when said sole clamp is in the closed position and exerts a force on said latching lever opposite a force exerted by said spring; and wherein when said sole clamp is n the closed position, said ski boot is secured to said ski and said latching lever is maintained in the latched position and when said sole clamp is in an open position, said ski boot is released from said ski and said latching lever is in the open position wherein the pivotable shaft can be elastically coupled with the lower part of the ski boot via the latching lever, in order to permit restricted pivoting of the pivotable shaft of the ski boot against a spring force, even when the pivotable shaft of the ski boot is latched; and wherein a transverse axle of the latching lever forming the lever pivot axis is guided in an elongate slot of the pivotable shaft of the ski boot and the latching lever is spring-loaded in order to bring about a substantially upright position of the shaft of the boot.

17. A binding coupled ski boot shaft delatching device comprising:

a latching lever, having a first end secured to a ski boot pivotable shaft and a free end detachably connected to a ski boot lower part, which secures said pivotable shaft to said lower part when in a latched position and wherein said pivotable shaft is pivotable when said latching lever is in an open position;

a first spring, coupled to said latching lever, for biasing said latching lever in the open position;

a sole clamp, having a boot engagement member which engages the lower part of said boot when said sole clamp is in a closed position and a latching lever engagement member which contacts an outer surface of said latching lever when said sole clamp is in the closed position and exerts a force on said latching lever opposite a forced exerted by said first spring; and wherein when said sole clamp is in the closed position, said boot is secured to said ski and said latching lever is maintained in the latched position and when said sole clamp is in an open position, said boot is released from said ski and said latching lever is in the open position;

a bearing part on which the sole clamp pivots about a transverse axis between the closed position and the open position;

a spring cage, fixedly connected with the sole clamp, which extends away from the bearing part;

a second spring, located within the spring cage and being braced at one end against the spring cage and acting at an other end on a latching piston which is displaceably mounted at the spring cage;

wherein a line of action of the second spring extends past and is spaced from a transverse axis to generate a closing moment;

a vertical release track arranged between the latching piston and the bearing part which brings about a deflection movement of the latching piston while increasing a spring tension during pivoting of the sole clamp about the transverse axis from the closed position to the open position;

wherein the bearing part is pivotally journalled about an at least substantially vertical axis (H) which is fixedly mounted to the ski and thus the sole clamp is also laterally pivotable; and a lateral release cam track arranged between the latching piston and a counterpiece, which is fixedly mounted relative to the ski, wherein the lateral release cam track brings about a displacement of the latching piston while increasing the spring tension during a lateral pivoting of the sole clamp from the closed position into a lateral opening direction wherein the lateral release cam track comprises a flat transverse surface of the spring-loaded latching piston and a flat countersurface of the counterpiece which is fixedly mounted relative to the ski.

18. A binding coupled ski boot shaft delatching device comprising:

a latching lever, having a first end secured to a ski boot pivotable shaft and a free end detachably connected to a ski boot lower part, which secures said pivotable shaft to said lower part when in a latched position and wherein said pivotable shaft is pivotable when said latching lever is in an open position;

a first spring, coupled to said latching lever, for biasing said latching lever in the open position;

a sole clamp, having a boot engagement member which engages the lower part of said boot when said sole clamp is in a closed position and a latching lever engagement member which contacts an outer surface of said latching lever when said sole clamp is in the closed position and exerts a force on said latching lever opposite a force exerted by said first spring;

wherein when said sole clamp is in the closed position, said boot is secured to said ski and said latching lever is maintained in the latched position and when said sole clamp is in the open position, said boot is released from said ski and said latching lever is in the open position;

a bearing part on which the sole clamp pivots about a transverse axis between the closed position and the open position;

a spring cage, fixedly connected with the sole clamp, which extends away from the bearing part;

a second spring, located within the spring cage and being braced at one end against the spring cage and acting at an other end on a latching piston which is displaceably mounted at the spring cage;

wherein a line of action of the second spring extends past and is spaced from a transverse axis to generate a closing moment;

a vertical release track arranged between the latching piston and the bearing part which brings about a deflection movement of the latching piston while increasing a spring tension during pivoting of the sole clamp about the transverse axis from the closed position to the open position;

wherein the bearing part is pivotally journalled about an at least substantially vertical axis (H) which is fixedly mounted to the ski and thus the sole clamp is also laterally pivotable; and a lateral release cam track arranged between the latching piston and a counterpiece, which is fixedly mounted relative to the ski, wherein the lateral release cam track brings about a displacement of the latching piston while increasing the spring tension during a lateral pivoting of the sole clamp from the closed position into a lateral opening direction; and wherein the counterpiece, which is fixedly mounted to the ski, is formed by a bearing spigot penetrating the bearing part which is fixedly mounted to the ski and which defines the vertical axis (H), with the bearing spigot penetrating the bearing part and being provided, at its outer end, which faces away from the ski, with the lateral release cam track.

19. A binding coupled ski boot shaft delatching device comprising:

a latching lever, having a first end secured to a ski boot pivotable shaft and a free end detachably connected to a ski boot lower part, which secures said pivotable shaft to said lower part when in a latched position and wherein said pivotable shaft is pivotable when said latching lever is in an open position;

a first spring, coupled to said latching lever, for biasing said latching lever in the open position;

a sole clamp, having a ski boot engagement member which engages the lower part of said ski boot when said sole clamp is in a closed position and a latching lever engagement member which contacts an outer surface of said latching lever when said sole clamp is in the closed position and exerts a force on said latching lever opposite a forced exerted by said first spring; and wherein when said sole clamp is in the closed position, said ski boot is secured to said ski and said latching lever is maintained in the latched position and when said sole clamp is in an open position, said ski boot is released from said ski and said latching lever is in the open position;

a bearing part on which the sole clamp pivots about a transverse axis between a closed position and an open position;

a spring cage, fixedly connected with the sole clamp, which extends away from the bearing part;

a second spring, located within the spring cage and being braced at one end against the spring cage and acting at an other end on a latching piston which is displaceably mounted at the spring cage;

wherein a line of action of the second spring extends past and is spaced from a transverse axis to generate a closing moment;

a vertical release track arranged between the latching piston and the bearing part which brings about a deflection movement of the latching piston while increasing a spring tension during pivoting of the sole clamp about the transverse axis from the closed position to the open position;

wherein the bearing part is pivotally journalled about an at least substantially vertical axis (H) which is fixedly mounted to the ski and thus the sole clamp is also laterally pivotable; and a lateral release cam track arranged between the latching piston and a counterpiece, which is fixedly mounted relative to the ski, wherein the lateral release cam track brings about a displacement of the latching piston while increasing the spring tension during a lateral pivoting of the sole clamp from the closed position into a lateral opening direct; an outer end of a bearing spigot which is associated with the lateral release cam track formed as a broadened head; and wherein the bearing part, is mounted on the bearing spigot, and arranged between the broadened head and the ski.

* * * * *